US005378112A

United States Patent [19]

Nasvytis

[11] Patent Number: 5,378,112

[45] Date of Patent: Jan. 3, 1995

[54] POSITIVE DISPLACEMENT, VARIABLE DELIVERY PUMPING APPARATUS

[75] Inventor: Pius J. Nasvytis, Avon, Conn.

[73] Assignee: P. J. Nasvytis International, Ltd., Avon, Conn.

[21] Appl. No.: 73,552

[22] Filed: Jun. 9, 1993

[51] Int. Cl.[6] ..... F04B 49/00

[52] U.S. Cl. ..... 417/213; 417/214; 417/300

[58] Field of Search ..... 417/213, 214, 218, 300; 418/17, 173

[56] References Cited

U.S. PATENT DOCUMENTS 2,509,256 5/1950 Sorensen ..... 417/213
2,938,469 5/1960 Lauck ..... 417/213

*Primary Examiner*—Richard A. Bertsch
*Assistant Examiner*—Alfred Basichas
*Attorney, Agent, or Firm*—William C. Crutcher

[57] ABSTRACT

A primary vane pump has a rotor with vanes, and an intermediate casing, which is also rotatable, both mounted in a fixed housing. The rotor vanes are enclosed in the casing and provide a primary pumping stage. The rotatable intermediate casing has outer vanes enclosed within the fixed housing, which provide a governor stage vane pump when the casing rotates. An inlet annulus supplies fuel to passages in the rotatable casing leading to the primary pumping stage and other passages in the rotatable casing conduct pumped fluid out to a discharge annulus. A closed fluid loop is established from discharge annulus to the governor stage vane pump, out through a valve and back to the discharge annulus. The reaction on the casing caused by the primary pump rotor tends to rotate the intermediate casing, while pressure drop through the valve in the closed fluid loop resists rotation. Adjustment of the valve adjusts rotational speed of the intermediate casing and varies the delivery rate of fuel by the primary vane pump.

18 Claims, 5 Drawing Sheets

POSITIVE DISPLACEMENT, VARIABLE DELIVERY PUMPING APPARATUS

BACKGROUND OF THE INVENTION

This invention relates generally to positive displacement, variable delivery pumping apparatus of the vane pump-type driven by either a constant speed or a varying speed power source and delivering controlled variable flow of a pumped liquid, such as fuel. More particularly, the invention relates to an improved two stage vane pump apparatus for delivering fuel to an aircraft jet engine or gas turbine at a controllable fuel flow rate which is independent of the driven speed of the pump.

Typically, liquid fuel is pumped to a gas turbine, such as a jet aircraft engine, using positive displacement, variable delivery pumping apparatus. Such positive displacement pumps have included gear pumps, vane pumps and piston pumps. Variable delivery has been achieved by changing the geometry of the positive displacement pump or by bypassing liquid to the inlet, both of which decrease the overall efficiency and require power as the flow is varied.

As gas turbine engine technology advances, engine manufacturers are requiring fuel systems which are light, compact, very efficient, and preferably operate from a single fuel demand control signal without regard for speed of the engine, and suitable for driving by any power source, i.e., the engine itself or a dedicated motor. For example the fuel needs of an aircraft jet engine are quite different during takeoff and during high altitude cruising.

Two stage pumping arrangements for jet engine fuel are also known which are combined with various accessory apparatus to meet the particular requirements of aircraft jet engines, which involve a large number of hydromechanical accessory devices in the overall fuel control system. All of the above add to the cost. It would be desirable to have a simplified positive displacement, variable delivery pumping apparatus which provides for variable flow of the pumped liquid suitable for either constant speed or variable speed drive and without the need to change the geometry of the pump hardware. Furthermore it would be desirable to have an improved variable delivery, positive displacement pumping apparatus which will operate without bypassing flow back to the inlet using simplified controls. Accordingly, one object of the present invention is to provide an improved positive displacement, variable delivery pumping apparatus which provides variable flow with simplified controls and more efficiently than existing pumping apparatus.

Another object of the invention is to provide an improved fuel delivery system for an aircraft jet engine.

Still another object of the invention is to provide a variable flow pump suitable for constant or variable input drive speed which is efficient and which operates with a simple control system.

SUMMARY OF THE INVENTION

Briefly stated, the invention comprises a primary vane pump comprising a primary rotor and an intermediate casing, both of which are rotatably mounted within a fixed housing. The casing also has vanes and forms a governor vane pump with the housing. A stationary inlet annulus and a stationary discharge annulus both communicate with passages within the rotatable primary vane pump and provide a primary pumped liquid flow path from a source of liquid to a user. A source of governing liquid is connected to feed the inlet of the governor vane pump, and the governor vane pump outlet is connected to a flow control valve and back to the governing liquid source. Operation of the flow control valve restricts flow of the governing liquid and adjusts speed of the intermediate casing to provide variable delivery from the primary liquid source to user.

In its preferred embodiment, the invention is practiced by providing a positive displacement, variable delivery vane-type pumping apparatus with a primary stage and a governor stage, comprising a primary pump rotor with circumferentially spaced moveable primary stage vanes, a rotatable intermediate casing with a noncircular primary pump cavity receiving the primary stage vanes and adapted to establish diametrically opposed primary suction chambers and diametrically opposed primary pressure chambers between the rotor and the intermediate casing when there is relative rotation therebetween. The rotatable intermediate casing further includes circumferentially spaced movable governor stage vanes and is rotatably mounted in a stationary housing which also rotatably mounts the pump rotor. The stationary housing includes a noncircular governor pump cavity arranged to receive the governor stage vanes and adapted to establish diametrically opposed governor suction chambers and diametrically opposed governor pressure chambers between the intermediate casing and the stationary housing when the intermediate casing rotates. A stationary inlet annulus and a stationary discharge annulus each define a circumferential opening communicating with ports in the rotatable intermediate casing. A first pair of passages in the rotatable intermediate casing connects the inlet annulus to the primary suction chambers. A second pair of passages in the rotatable intermediate casing connects the primary pressure chamber to the discharge annulus. A third pair of passages connects the discharge annulus to the governor suction chambers. A fourth conduit including a pair of internal passages is connected between the governor pressure chambers and an external flow control valve, and a fifth conduit connects the flow control valve back to the discharge annulus.

In a modified form of the invention, the governor suction chamber is supplied from the inlet annulus and the flow control valve outlet is connected back to the inlet annulus.

In either the preferred embodiment or the modified form, rotational torque tending to rotate the intermediate casing is provided by pressure difference of the primary liquid between inlet and discharge annulus caused by rotation of the primary rotor and the downstream passage restrictions. Counter rotational torque tending to resist rotation of the intermediate casing is provided in the governor stage by regulated pressure drop of the governing liquid across the flow control valve. Speed of rotation of the intermediate casing as a result of two opposite rotational torques determines the volumetric flow rate of the primary liquid supplied by the primary stage to the engine. The primary liquid and governing liquid are preferably the same liquid and derived from the same source, but not necessarily so.

DRAWINGS

The invention, both as to organization and method of practice, together with further objects and advantages thereof, will best be understood by reference to the following specification, taken in connection with the accompanying drawings, in which;

FIG. 1 is a horizontal elevation drawing, in cross section, of my improved positive displacement, variable delivery pumping apparatus, with angular offset of the rotating elements as indicated by lines I—I in FIG. 3, FIGS. 2, 3 and 4 are end elevational views, taken in cross section along lines II—II, III—III, and IV—IV, respectively of FIG. 1, FIG. 5 is an enlarged schematic end view, in cross section, of a typical spring loaded vane in the governor stage, FIG. 6 is an exploded schematic view of the pumping apparatus showing layout of fluid conduits and flow control valve of a preferred embodiment of the invention, FIG. 7 is a similar exploded schematic view of a modified from of the invention, FIG. 8 is a diagrammatic simplified view illustrating operation of the preferred embodiment, FIG. 9 is a simplified schematic illustrating operation of the modified form of the invention, FIG. 10 is a graph illustrating performance of the pumping apparatus using a constant speed drive, and FIG. 11 is a graph illustrating performance of the invention utilizing a variable speed drive.

DESCRIPTION OF THE PREFERRED EMBODIMENT

Figure 1:
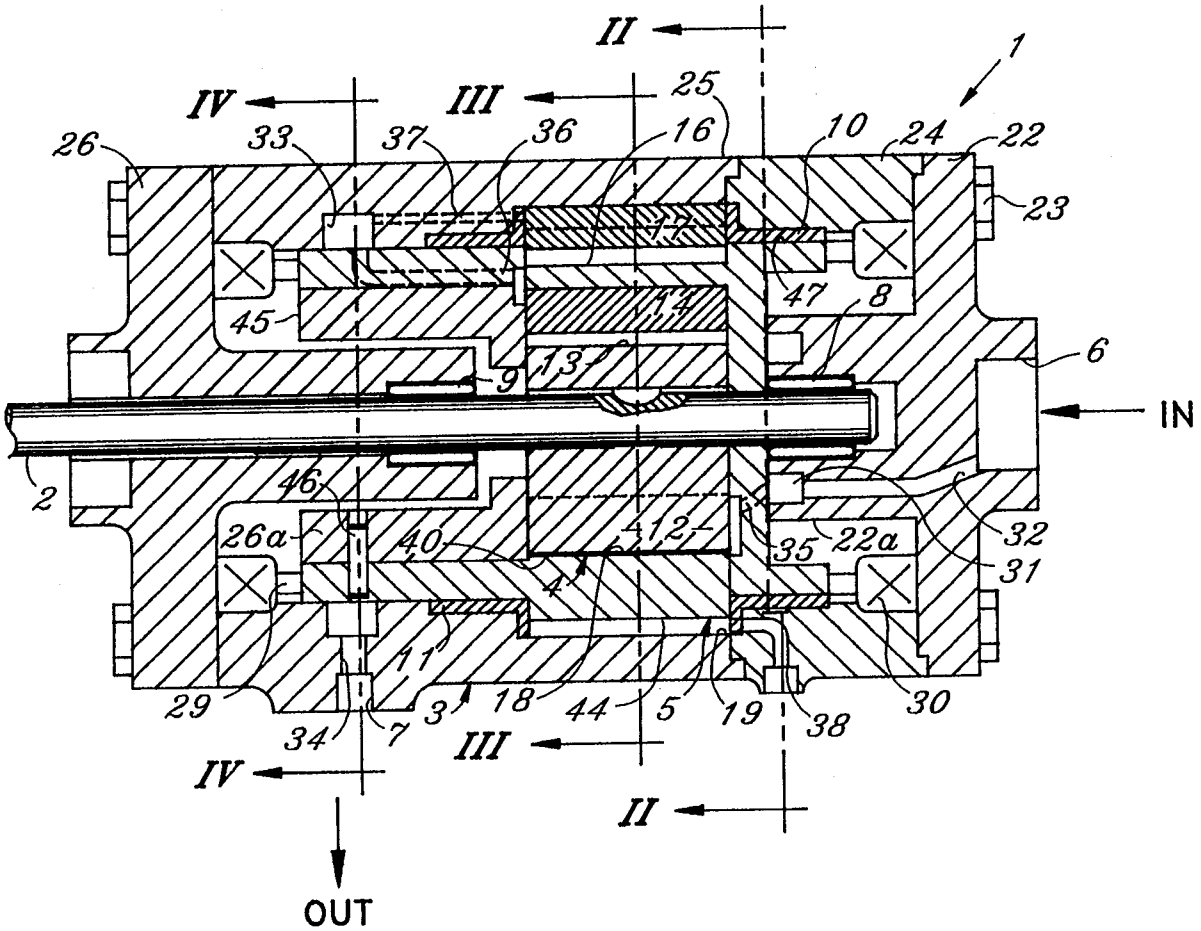

Referring now to FIG. 1 of the drawing, the invention is illustrated in simplified form as a two stage vane-type positive displacement pump indicated generally at 1 and driven by either a constant speed or variable speed motor or engine (not shown) through an input shaft 2. The pumping apparatus 1 is made up of a fixed pump housing 3, a primary pump rotor 4, and an intermediate rotatable casing 5 interposed therebetween, best seen in FIG. 3 cross section. The pump housing 3 is connected at an inlet opening 6 to a source of pressurized primary liquid, such as jet engine fuel, (not shown) and a controlled supply of pumped primary liquid leaves housing 3 through a discharge connection 7. Primary pump rotor 4 is rotatably mounted in the housing 3 by means of roller bearings 8, 9. Intermediate casing 5 is also rotatably mounted in the housing 3 by means of sleeve bearings 10, 11. The pump rotor 4 comprises a central cylindrical body 12 having longitudinal circumferentially spaced slots 13, in each of which is disposed a movable primary stage vane 14.

Figure 3:
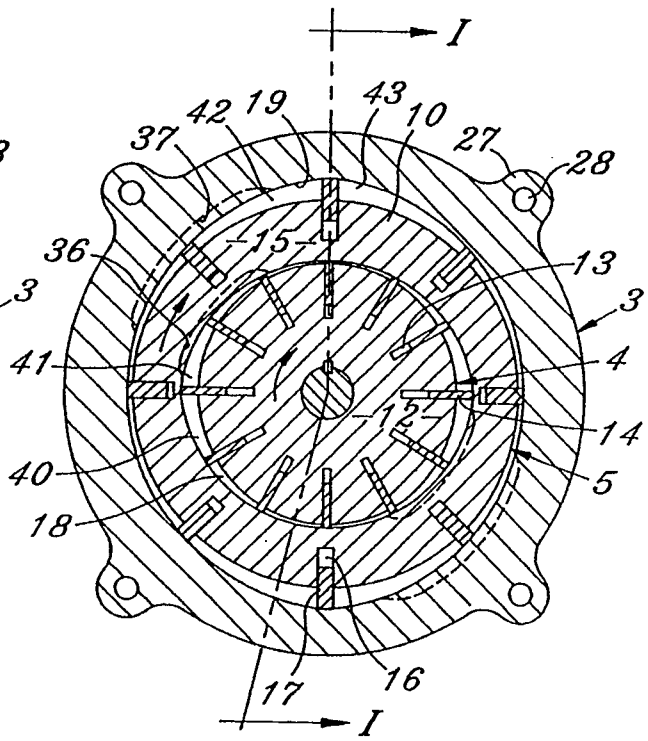

As best seen in FIG. 3, intermediate casing 5 includes a central cylindrical body 15 having longitudinal circumferentially spaced slots 16, in each of which is disposed a movable governor stage vane 17. The intermediate casing 15 has an inner noncircular cavity 18 which receives the ends of the vanes 14 to provide a primary stage vane pump when there is relative rotation between rotor 4 and intermediate casing 5. The term relative rotation is used, because in practice both rotor 4 and casing 5 may be rotating and only relative movement between the two creates a pressure difference across the vanes and flow from the primary pump inlet to outlet.

Housing 3 also has an inner noncircular cavity 19 receiving the ends of vanes 17 to form a governor stage.

Figure 5:
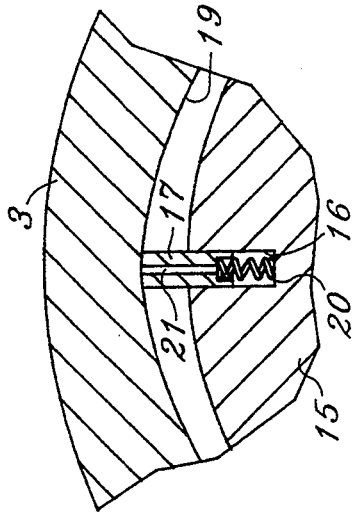

Reference to FIG. 5 of the drawing illustrates an enlarged view of the governor stage vanes 17 which are preferably each loaded by a compression spring 20 and include a pressure balancing conduit 21 therethrough. This is to insure that vanes 17 are always extended from slots 16 against the chamber wall 19 even when intermediate casing 5 is not rotating.

Figure 4:
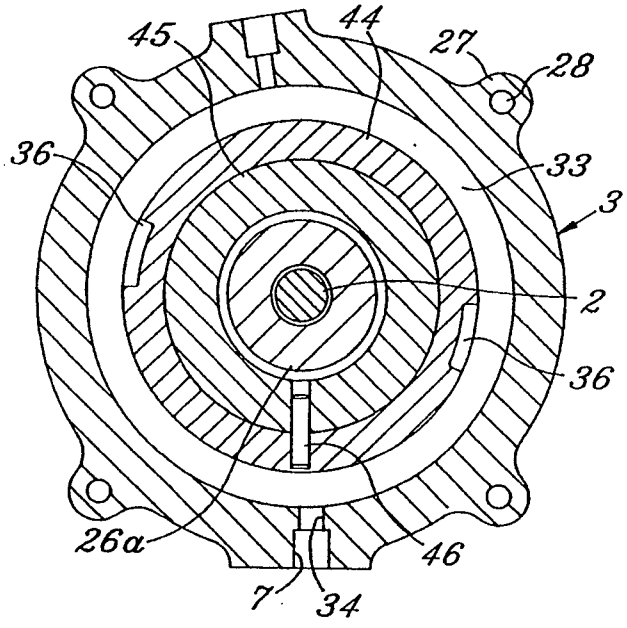
Figure 2:
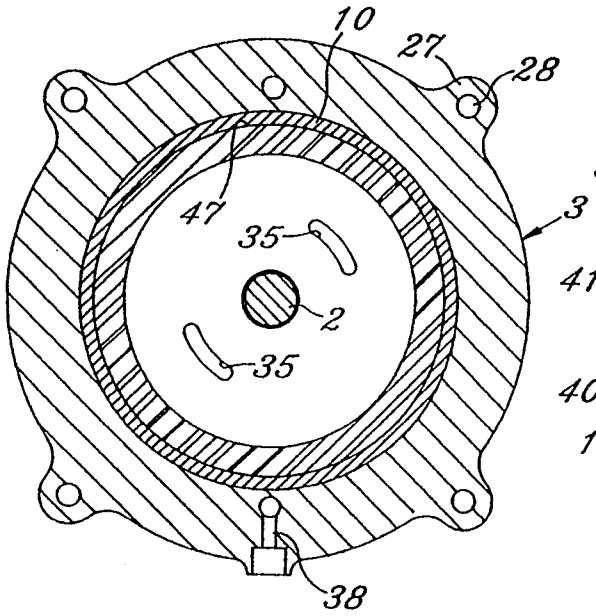

Housing 3 is illustrated in simplified form as comprising an inlet face plate 22 having an inner axially extending boss 22*a* supporting the stub end of shaft 2 in the roller bearings 8. Attached to the face plate 22 by bolts 23 is a housing inlet sleeve 24, a housing body 25, and housing drive end face plate 26. The drive end face plate includes an inner axially extending boss 26*a* supporting shaft 2 in the roller bearings 9. Housing sleeve 24 and housing body 25 are arranged to hold the sleeve bearings 10 and 11 respectively which rotatably support the intermediate casing 5. The details of construction of housing 3 are merely exemplary to illustrate a simplified construction and housing 3 may take other forms and shapes to meet the physical needs of a particular pump. As seen in FIGS. 2, 3 and 4 the housing includes longitudinal ribs 27 with axial holes 28 receiving the bolts 23. The opposite ends of intermediate casing 5 are sealed against fluid leakage across the ends by means of conventional spring loaded carbon face seals 29, 30.

In order to provide for a continuous supply of primary liquid from inlet opening 6 to internal passages in the rotatable intermediate casing 5, there is provided a stationary inlet annulus 31. This is suitably provided as a circumferential groove in the end of the boss 22*a* and connected to inlet 6 by passage 32. Similarly, in order to provide for a continuous egress of primary liquid from rotatable casing 5, there is provided a stationary discharge annulus 33. This is provided by means of a circumferential groove in the housing body 25 and connected to the discharge port 7 by means of a passage 34. A pair of first internal conduits 35 connect inlet annulus 31 to the ends of diametrically opposed primary suction chambers 40 (see FIG. 3). A pair of second conduits 36 connect the ends of diametrically opposed primary pressure chambers 41 in the intermediate casing 5 to the discharge annulus 33. A pair of third conduits 37, connect discharge annulus 33 to the ends of diametrically opposed governor stage suction chambers 42. A pair of fourth conduits 38 lead from diametrically opposed governor pressure chambers 43 to a flow control valve as will be explained later in the specification.

Intermediate casing 5 is made up of a cylindrical barrel shaped body number 44 with an inner sleeve 45 rotatably connected thereto by one or more radial pins 46. This is to allow insertion and removal of the primary pump rotor during assembly. Body 44 includes journals 47, 48 fitting within sleeve bearings 10, 11 respectively.

Figure 6:
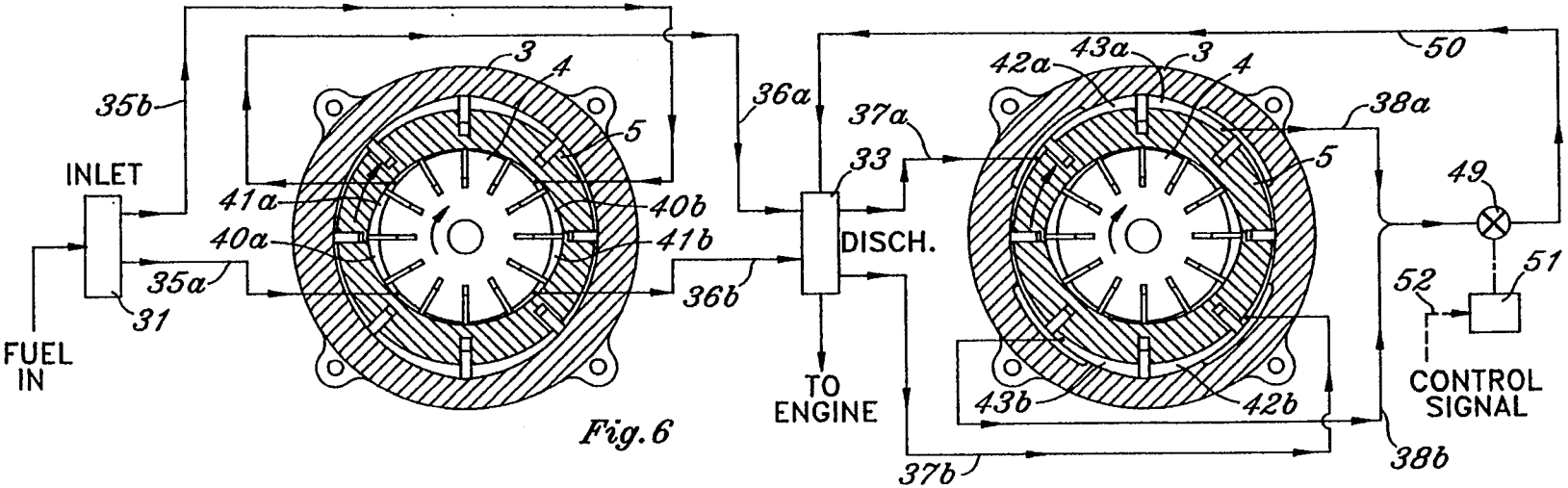

Referring now to the exploded schematic view of the preferred embodiment shown in FIG. 6, the primary stage shown on the left hand side has been separated from the governor stage shown on the right hand side in order to facilitate understanding of the flow of the pumped liquid. The primary stage is supplied by means of a pair of diametrically opposed primary suction chambers 40*a*, 40*b* established in the clearance space of gradually increasing volume (as determined by the direction of rotation of rotor 4 relative to intermediate casing 5). Similarly, a pair of diametrically opposed primary pressure chambers 41*a*, 41*b* are established in the clearance space of decreasing volume between rotor 4 and casing 5. In the same manner in the governor stage on the right, diametrically opposed governor suction chambers 42*a*, 42*b* and governor pressure chambers 43*a*, 43*b* are established in regions of increasing and decreasing volume respectively. A pair of first conduits 35*a*, 35*b* connect inlet annulus 31 to primary suction chambers 40*a*, 40*b*. A pair of second conduits 36*a*, 36*b* connect primary pressure chambers to the discharge annulus 33. A pair of third conduits 37*a*, 37*b* connect the discharge annulus 33 to governor suction chambers 42*a*, 42*b*. Lastly, conduits 38*a*, 38*b* connect governor pressure chambers 43*a*, 43*b* to the inlet of a flow control valve 49. The outlet side of flow control valve 49 is reconnected to discharge annulus 33 by means of a conduit 50.

Flow control valve 49 is provided with a servo positioning mechanism 51 in response to a fuel demand signal 52 representing a desired rate of fuel flow from the pumping apparatus to the engine. The conduit 50 connecting the outlet of flow control valve 49 back to the discharge annulus is at substantially the same pressure as that of the discharge annulus and conduits 37*a*, 37*b* leading to the suction chambers of the governor stage.

There are two major liquid flow paths.

First, there is an open loop flow path from primary liquid source to the user, in this case gas turbine or aircraft jet engine using combustible fuel at a variable pumped rate of flow. A primary conduit means is established from inlet annulus to primary pump suction chambers to primary pump pressure chambers to discharge annulus to engine.

Secondly, there is a closed loop flow path of governing liquid which governs the rate of pump delivery. In the preferred embodiment shown, the governing liquid is the same liquid as the primary liquid, i.e., the primary fuel supply also operates the governor stage. However, it is possible to use a different liquid from a second liquid source to serve as the governing liquid. A governor conduit means is established from a governing liquid source, in this case the discharge annulus, to governor suction chambers to governor pressure chambers to flow control valve and back to the governing liquid source (or discharge annulus).

Figure 8:
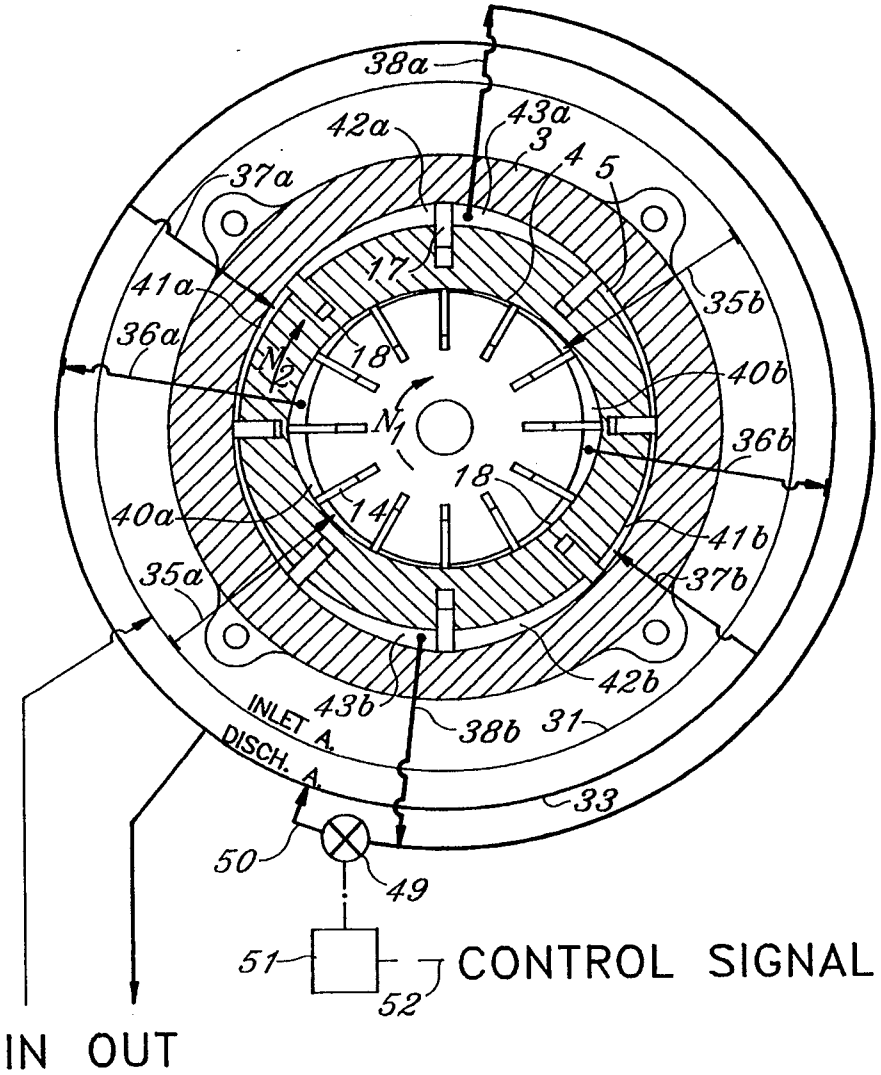

Referring now to FIG. 8 of the drawing, a diagrammatic representation is made for the purpose of explaining the operation. The same reference numerals are used as in connection with FIG. 6, except that both stages are drawn together and the stationary inlet annulus and discharge annulus 31 and 33 respectively are shown encircling the apparatus to indicate that they are actually stationary and circumferentially disposed with respect to the rotatable members of the apparatus. Furthermore, the first conduits 35*a*, 35*b* and the second conduits 36*a*, 36*b* are shown with sliding connections to indicate that they actually are rotatable along with the intermediate casing 5 with respect to the stationary annuli.

FIG. 8 is drawn with conduits shown as single lines of three different thicknesses to indicate that there are different liquid pressure levels within the conduits, the thinner lines indicating lower pressure and the thick lines indicating higher pressure. Three different pressure levels are indicated in FIG. 8, it being assumed that the intermediate casing 5 is rotating at some rotational speed $N_2$ which is less than the rotational speed $N_1$ of the driven primary rotor 4.

As indicated in FIG. 8, inlet annulus 31, first conduits 35*a*, 35*b* and primary suction chambers 40*a*, 40*b* are at substantially the same low pressure (disregarding slight pressure drops through the passages). Primary pressure chambers 41*a*, 41*b*, second conduits 36*a*, 36*b* and discharge annulus 33 are at some intermediate pressure which corresponds to the pressure at which fuel is supplied by the primary stage to the engine. Also the discharge annulus acts as a governing liquid source. Therefore, third conduits 37*a*, 37*b* connected to governor stage suction chambers 42*a*, 42*b*, and conduit 50 from the outlet of flow control valve 49 are also connected to discharge annulus 33, and are therefore approximately at this intermediate pressure.

Lastly, conduits 38*a*, 38*b* from the governor pressure chambers 43*a*, 43*b* are at a higher pressure and are connected to the inlet of flow control valve 49.

Operation

In general terms, the primary pump stage delivers primary liquid, in this case jet engine fuel, from the discharge annulus at a volumetric rate of flow determined by the relative rate of rotation between primary rotor 4 rotating at speed $N_1$ and intermediate casing 5 rotating at speed $N_2$. When the primary rotor turns, the vanes 14 are either sweeping through suction chambers of increasing volume or pressure chambers of decreasing volume. The differential pressure thus developed is exerted on the projected areas of the intermediate casing cavity 18, seen in FIG. 8 to exert a clockwise rotational torque on casing 5.

If the intermediate casing 5 were mechanically locked in place, as in a conventional vane pump, the liquid fuel would be delivered from the discharge annulus at a volumetric rate of flow proportional to the primary rotor speed $N_1$. However, in the present invention, intermediate casing 5 is rotatably mounted. A closed loop flow path of governing liquid is established through a governor conduit means from discharge annulus to the governor stage suction chambers 42*a*, 42*b* to the governor pressure chambers 43*a*, 43*b* (whenever casing 5 is rotating), through flow control valve 49 and back to the discharge annulus 33. This is best seen in FIG. 6. If the flow control valve 49 is totally closed, the clockwise torque exerted on casing 5 creates sufficient pressure in governor pressure chambers 43*a*, 43*b* to exert an equal and opposite counter rotational torque on vanes 17 and, assuming no leakage, prevents rotation of intermediate casing 5. This is equivalent to mechanically locking casing 5 in place and results in the highest rate of fuel supply pumped by the primary stage.

At the other end of the spectrum, if flow control valve 49 is completely open and assuming no pressure drop through the conduits, and neglecting friction, the clockwise torque exerted on casing 5 will cause it to rotate synchronously at a speed $N_2$ corresponding to speed $N_1$ and there will be no relative rotation between rotor 4 and casing 5, hence no fuel pumped to the engine.

Governing to provide variable delivery of liquid fuel is provided by selectively positioning control valve 49 as exemplified by a servo mechanism 51 controlled by a fuel demand control signal 52. Restriction of flow of governing liquid through the control valve in the closed loop governing liquid circuit causes a pressure drop across the valve and a corresponding pressure rise between governor suction and pressure chambers. This latter pressure difference provides a counter-rotational torque on intermediate casing 5 which, in turn, causes it to rotate at speed N2 which is less than that of primary rotor $N_1$.

Figure 10:
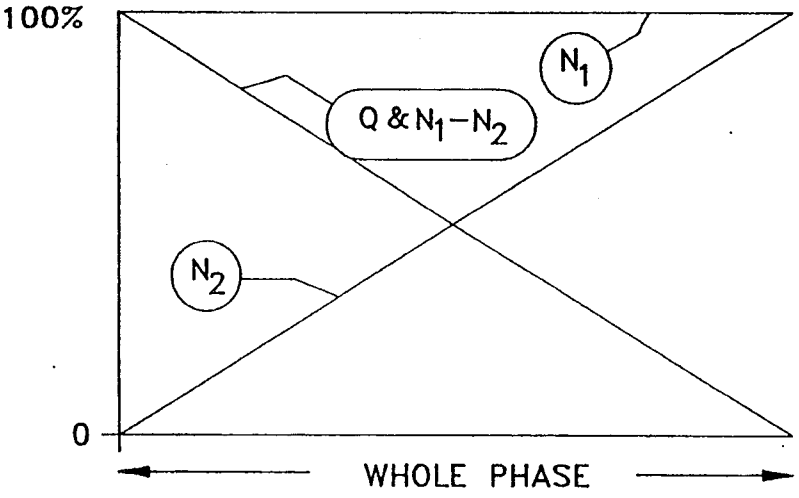

Reference to FIG. 10 illustrates the characteristics of the pumping apparatus when rotor 4 is driven at a constant speed $N_1$. The abscissa represents valve opening and the ordinate represents either rotational speed or volumetric flow Q from the discharge annulus. As control valve 49 is opened, rotational speed $N_2$ of the intermediate casing 5 increases, and the relative rotational speed $N_1$ minus $N_2$ decreases, as well as the volumetric flow Q.

Figure 11:
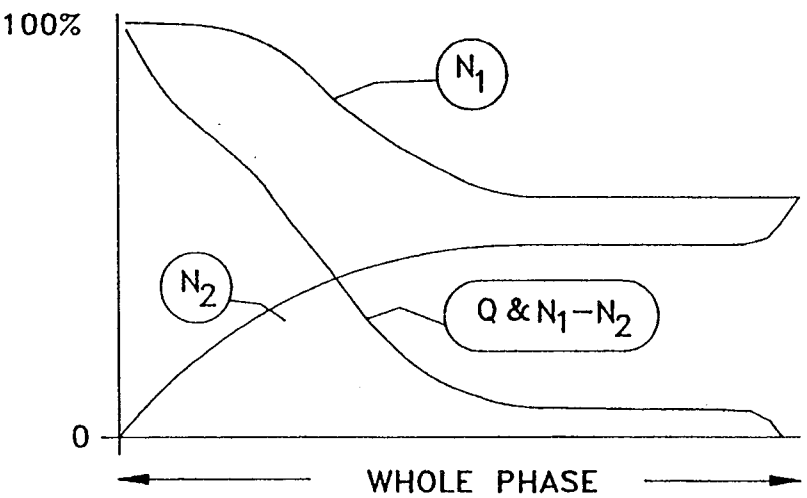

Reference to FIG. 11 illustrates flow characteristics of the pumping apparatus when the primary rotor 4 is driven by a variable speed motor. For example, if the primary rotor were directly geared to the output shaft of the gas turbine which is being supplied with fuel, the speed $N_1$ would vary. In the same manner as before, opening of the flow control valve (corresponding to the change in $N_1$) causes the relative rotational speed $N_1$ minus $N_2$ and the volumetric rate of flow Q to decrease, as indicated in the graph of FIG. 11.

Modification

Figure 7:
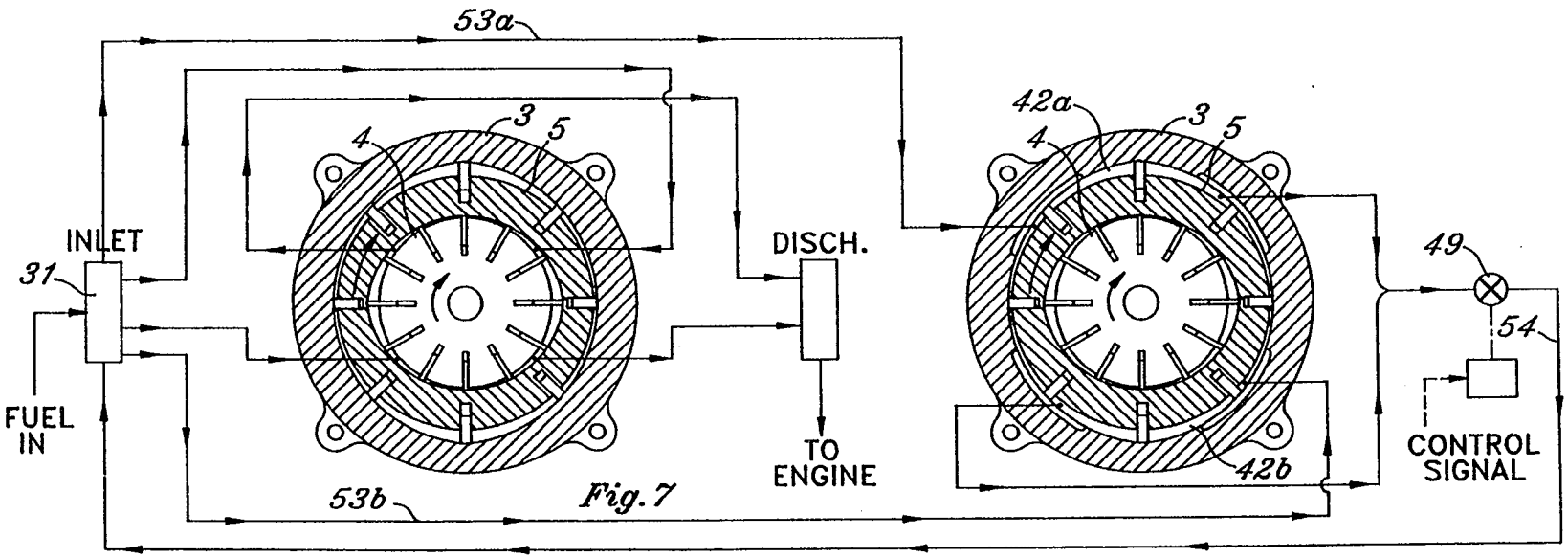
Figure 9:
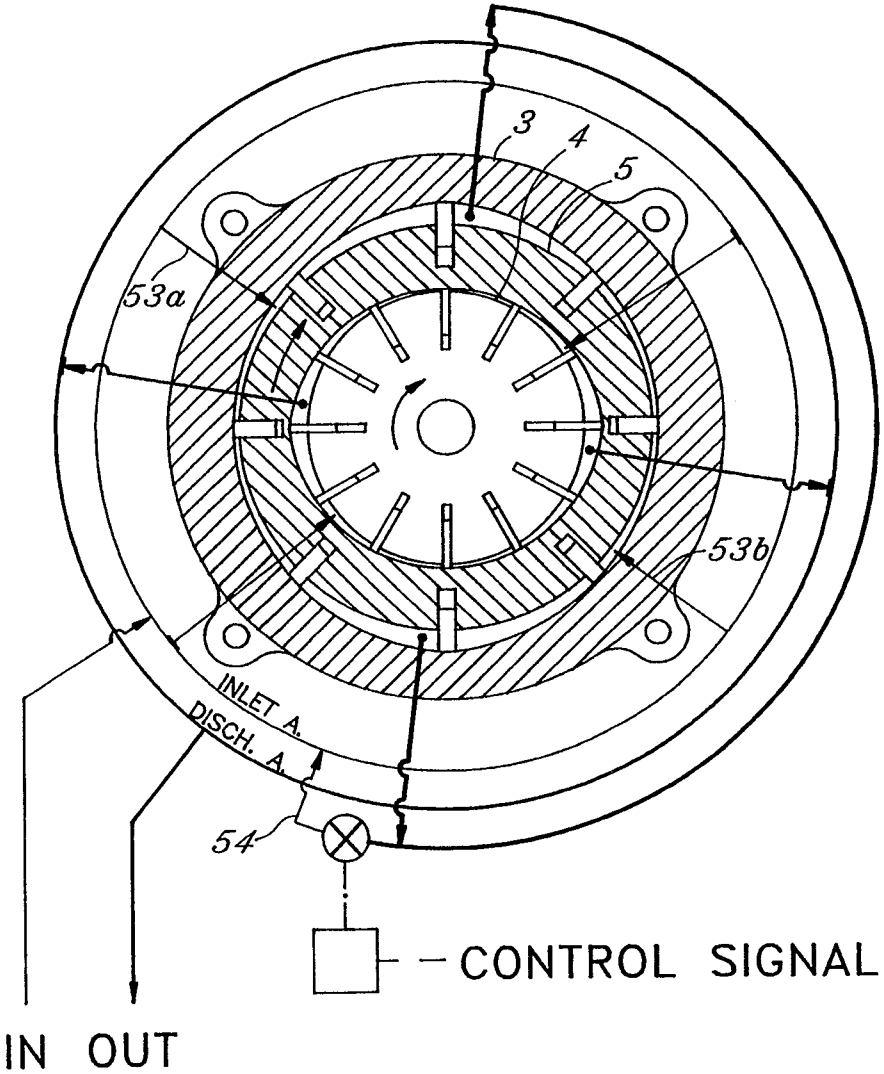

While I have described the preferred form of the invention, a modified form is illustrated in FIGS. 7 and 9. In order not to obscure the drawing and to illustrate the differences, only the conduits which are different from those in the corresponding FIGS. 6 and 9, and elements discussed in the following description, have been shown with reference numbers. Since the path of governing liquid through the governor stage and control valve is a continuous closed circuit, it can be obtained from and returned to any convenient source of governing liquid. As seen in FIG. 7, the inlet annulus 31 is utilized rather than the discharge annulus for the source of governing liquid.

Conduits 53*a*, 53*b* are substituted for conduits 37*a*, 37*b* shown in FIG. 6. Similarly, the return from the outlet of control valve 49 is shown as a conduit 54 returning to the inlet annulus in lieu of the conduit 50 shown in FIG. 6. Similarly, these changes are indicated in FIG. 9. It will be observed that while some pressure difference is developed across vanes 17 in the governor stage, the pressure level will be lower, since the pressure at the governor suction cavities corresponds to inlet annulus pressure. This lower pressure level may lead to improved geometries for some applications.

It is possible to utilize a different liquid source for the governing liquid flow path if it is suitably separated from the primary liquid in the pumping apparatus. The governing control loop can be placed and controlled remotely, which may be beneficial for some applications. It is also possible to arrange the pressure and suction chambers of both the primary stage and governing stage in any suitable arrangement. Vane pumps may have any number of lobes from only one lobe, which is most frequently used in variable displacement vane pumps, up to four lobes. I prefer the diametrically opposed chambers shown, but this is not meant to limit the claimed invention.

In either its preferred form or in the modified form shown in the drawings and description, the invention provides many advantages over conventional positive displacement, variable delivery pumping apparatus. Because it is unnecessary to change the geometry of the pump to vary the delivery rate, a very efficient fuel delivery system is possible. Secondly, the means of control of fuel delivery is extremely simple, requiring only a flow control valve. Third, the wear on the vanes is reduced, because wear depends upon the sliding velocity of the vanes. Assuming that the pumping apparatus operates with the intermediate casing turning at some speed less than the driven rotor, the vanes of both pump stages are sliding across their respective cavity walls at a lower speed and hence with less wear.

While there is disclosed herein what is considered to be the preferred embodiment of the invention and one modification thereof, it is desired to secure in the appended claims all such modifications as fall within the true spirit and scope of the invention.

I claim:

1. Positive displacement, variable delivery pumping apparatus, comprising:

a primary liquid source, a primary vane pump having a primary vaned rotor driven within an intermediate casing and adapted to pump liquid from said primary liquid source to a user, a governor vane pump comprising said intermediate casing disposed within a housing, said intermediate casing having vanes and being rotatably mounted within said housing, primary conduit means including an inlet annulus and a discharge annulus each communicating with said intermediate casing and providing a primary pumped liquid flow path from said primary liquid source to said user through said primary vane pump, a governing liquid source, a flow control valve, and governor conduit means providing a governing liquid flow path from a governing liquid source through said governor vane pump and through said flow control valve and back to said governing liquid source, whereby operation of said flow control valve adjusts rotational speed of said intermediate casing and provides variable delivery from said primary liquid source to said user.

2. The combination according to claim 1, wherein said discharge annulus serves as said governing liquid source.

3. The combination according to claim 1, wherein said inlet annulus serves as said governing liquid source.

4. Positive displacement, variable delivery pumping apparatus, comprising:

a pump housing, a primary pump rotor rotatably mounted in said housing and having a plurality of circumferentially spaced movable primary stage vanes, a rotatable intermediate casing rotatably mounted in said housing coaxially with said pump rotor and defining a non-circular primary pump cavity arranged to receive said primary stage vanes and adapted to establish at least one primary pressure chamber and at least one primary suction chamber between said rotor and said intermediate casing when there is relative rotation therebetween, said intermediate casing further including a plurality of circumferentially spaced, movable governor stage vanes, said pump housing defining a non-circular governor pump cavity arranged to receive said governor stage vanes and adapted to establish at least one governor pressure chamber and at least one governor suction chamber between said intermediate casing and said pump housing when the intermediate casing rotates, means for rotating said primary rotor, a primary liquid source, a stationary inlet annulus connected to said liquid source and adapted to provide continuous communication with said primary suction chamber as said intermediate casing rotates, a stationary discharge annulus adapted to provide continuous communication with said primary pressure chamber as said intermediate casing rotates, whereby primary liquid is pumped from inlet annulus to discharge annulus in response to relative rotation between primary rotor and intermediate casing while said primary rotor also exerts a rotational torque on said intermediate casing, a source of governing liquid, a flow control valve adapted to restrict governing liquid flow, and governor conduit means establishing a continuous governing liquid path from said governing liquid source to said governor suction chamber from said governor pressure chamber through said flow control valve and back to said governing liquid source, whereby rotational torque on said intermediate casing develops a counter rotational torque on said intermediate casing responsive to pressure drop across said flow control valve, so as to selectively vary the rotational speed of said intermediate casing.

5. The combination according to claim 4, wherein said inlet annulus is defined in said pump housing and wherein said intermediate casing defines at least one rotatable first conduit connected to said primary suction chamber and continuously communicating with said inlet annulus as the intermediate casing rotates.

6. The combination according to claim 5, wherein there are two of said primary suction chambers diametrically opposed from one another, and wherein there are a pair of said rotatable first conduits respectively connected thereto.

7. The combination according to claim 4, wherein said discharge annulus is defined in said pump housing and wherein said intermediate casing defines at least one rotatable second conduit connected to said primary pressure chamber and continuously communicating with said discharge annulus as the intermediate casing rotates.

8. The combination according to claim 7, wherein there are two of said primary pressure chambers diametrically opposed from one another, and wherein there are a pair of said rotatable second conduits respectively connected thereto.

9. The combination according to claim 4 wherein there are two of said governor pressure chambers diametrically opposed from one another, and two of said governor suction chambers diametrically opposed from one another.

10. The combination according to claim 4 wherein said means rotating said primary rotor is a constant speed motor.

11. The combination according to claim 4 wherein said means rotating said primary rotor is a variable speed power source.

12. The combination according to claim 4, wherein said primary liquid is combustible fuel and wherein said discharge annulus comprises said governing liquid source, said primary rotor being adapted to be rotated by the user of said combustible fuel.

13. The combination according to claim 4 wherein said means rotating said primary rotor is an electric constant speed motor and including a servomechanism adapted to position said flow control valve in response to a control signal.

14. The combination according to claim 4, wherein said discharge annulus comprises said governing liquid source.

15. The combination according to claim 4, wherein said inlet annulus comprises said governing liquid source.

16. The combination according to claim 4, wherein said pump housing defines at least one third conduit connecting said discharge annulus to said governor suction chamber.

17. The combination according to claim 4, wherein said pump housing defines at least one fourth conduit connected to said governor pressure chamber, said fourth conduit being further connected to said flow control valve.

18. Positive displacement, variable delivery vaned pumping apparatus, comprising:

a pump housing, a primary pump rotor rotatably mounted in said housing and having a plurality of circumferentially spaced movable primary stage vanes, a rotatable intermediate casing rotatably mounted in said housing coaxially with said pump rotor and defining a non-circular primary pump cavity arranged to receive said primary stage vanes and adapted to establish diametrically opposed primary pressure chambers and diametrically opposed primary suction chambers between said rotor and said intermediate casing when there is relative rotation therebetween, said intermediate casing further including a plurality of circumferentially spaced, movable governor stage vanes, said pump housing defining a non-circular governor pump cavity arranged to receive said governor stage vanes and adapted to establish diametrically opposed governor pressure chambers and diametrically opposed governor suction chambers between said intermediate casing and said pump housing when the intermediate casing rotates, a stationary inlet annulus and a stationary discharge annulus, each said annulus defining a circumferential opening communicating with said rotatable intermediate casing, a source of pressurized liquid connected to said inlet annulus, first conduit means defined in said intermediate casing and connecting said inlet annulus to said primary suction chambers, second conduit means defined in said intermediate casing and connecting said primary pressure chambers to said discharge annulus, third conduit means connecting said discharge annulus to said governor suction chambers, flow control valve adapted to selectively restrict flow therethrough, fourth conduit means connected between said governor pressure chambers and said flow control valve, and fifth conduit means connecting said flow control valve to said discharge annulus, whereby operation of said flow control valve varies rotational speed of said intermediate casing and thereby varies delivery by said pumping apparatus.

* * * * *